US008087878B2

(12) United States Patent
Chen

(10) Patent No.: US 8,087,878 B2
(45) Date of Patent: Jan. 3, 2012

(54) POWERLESS DIVERSION PLATE OF A CEILING AIR-CONDITIONING CIRCULATION MACHINE

(76) Inventor: Yung-Hua Chen, Sinjhuang (TW)

( * ) Notice: Subject to any disclaimer, the term of this patent is extended or adjusted under 35 U.S.C. 154(b) by 406 days.

(21) Appl. No.: 12/453,942

(22) Filed: May 28, 2009

(65) Prior Publication Data

US 2010/0303617 A1 Dec. 2, 2010

(51) Int. Cl.

| | |
|---|---|
| ***F03D 11/00*** | (2006.01) |
| ***F03D 1/04*** | (2006.01) |
| ***F03D 3/04*** | (2006.01) |
| ***F01D 1/02*** | (2006.01) |
| ***F01D 9/00*** | (2006.01) |
| ***F03B 1/04*** | (2006.01) |
| ***F03B 3/16*** | (2006.01) |
| ***F04D 29/44*** | (2006.01) |
| ***F04D 29/54*** | (2006.01) |
| ***F25D 23/12*** | (2006.01) |
| ***F25D 17/06*** | (2006.01) |

(52) U.S. Cl. .... 415/98; 415/187; 415/208.2; 415/219.1; 62/263; 62/426

(58) Field of Classification Search ..... 415/98, 415/173.6, 187, 208.2, 219.1; 62/125, 263, 62/426

See application file for complete search history.

(56) References Cited

U.S. PATENT DOCUMENTS

| | | | | |
|---|---|---|---|---|
| 6,257,502 | B1 * | 7/2001 | Hanish et al. | 239/290 |
| 6,736,610 | B2 * | 5/2004 | Cifarelli | 417/366 |
| 2009/0314020 | A1 * | 12/2009 | Yoshioka et al. | 62/238.6 |
| 2010/0269537 | A1 * | 10/2010 | Tadokoro et al. | 62/426 |

* cited by examiner

*Primary Examiner* — David S Blum
(74) *Attorney, Agent, or Firm* — Rosenberg, Klein & Lee

(57) ABSTRACT

A powerless diversion plate of a ceiling air-conditioning circulation machine includes a bearing block and a bearing within a circular inflow/outflow hole for installing a diversion disc having a plurality of radial separation pieces. A plurality of conic and ring-shaped diversion pieces are positioned around the connection shaft. The diversion disc is separated by the ring-shaped diversion pieces and the radial separation pieces to create air inflow/outflow zones. The diversion disc has a downward protruding middle part and a staged structure at the rim thereof to form a predetermined shape. This obviates a powered motor, as the radial separation pieces of the diversion disc serve as a working surface, and respond to forced air for causing the diversion disc to be driven in 360° rotation to diffuse air downward or suck air upward in a flowing way, thereby enhancing air-outflowing and convection efficiency and reducing energy consumption and carbon release.

3 Claims, 8 Drawing Sheets

POWERLESS DIVERSION PLATE OF A CEILING AIR-CONDITIONING CIRCULATION MACHINE

BACKGROUND OF THE INVENTION

1. Field of the Invention

The invention relates to a powerless diversion plate of a ceiling air-conditioning circulation machine, and more particularly to a structure that ensures a powerless rotation of a diversion disc at 360° which is mounted in an air inflow/outflow hole. In this way, a /\-shaped downward diffusion or an upward suction of the current of air is achieved.

2. Description of the Related Art

When offices or factories are interiorly decorated, the ceiling is often made by light steel frame in a grid shape. Thereafter, the ceiling is placed in the grid frame. This kind of the construction way is simple and has low cost. Thus, it is widely used.

In order to enhance the convection of the indoor air, an air-conditioning circulation machine or a fan is often placed into the grid frame. As shown in FIG. 1, a circulation fan 12 extra for a ceiling steel frame is installed at the bottom of an upper housing 11. A lower housing 13 includes an air outflow hole 14 formed in a circular shape and corresponding to the circulation fan 12. An air outflow disc 15 is positioned within the air outflow hole 14 such that the air is expelled from the air outflow disc 15 when the air is sucked from an air inflow opening 16 at the rim of the lower housing 13. In this way, an increased convection of the indoor air is guaranteed.

However, the air outflow disc 15 is fixed in the air outflow hole 14 and can't rotate. As a result, the air can be delivered downward through the gap of the air outflow disc 15 without the function of diffusion and diversion.

In order to achieve the rotation of the air outflow disc 15, an automatic rotation motor 17 has to be installed at the top of the center of the air outflow disc 15 for driving the air outflow disc 15 in rotation (see FIG. 2). This kind of structure is disclosed in TW M345885. Moreover, the air outflow disc is provided with a tooth ring at the rim thereof, as disclosed in TW M322475. A motor is employed to drive a pinion (not shown) engaged with the toothed ring so as to drive the air outflow disc 15 in rotation.

Thus, a motor used as a power source is necessary for driving the air outflow disc in rotation to enhance the convection. However, this will make the structure complicated. Moreover, the cost will be increased. Therefore, a further improvement is required.

SUMMARY OF THE INVENTION

An object of the invention is to provide a powerless diversion plate of a ceiling air-conditioning circulation machine through which it is not necessary to install a motor to drive a diversion disc. Instead, many radial separation pieces of the diversion disc serve as working surface. When an air delivery force created by the fan acts on the radial separation pieces, the diversion disc is driven in rotation at 360°. In this way, a powerless and automatic rotation is achieved for guiding the current of air.

Another object of the invention is to provide a powerless diversion plate of a ceiling air-conditioning circulation machine wherein, in addition to the automatic rotation, the diversion disc enables the air to be diffused downward or sucked upward in a /\-shaped flowing way, thereby enhancing the air-outflowing and convection efficiency.

In order to achieve the above-mentioned object, a powerless diversion plate of a ceiling air-conditioning circulation machine in accordance with the invention includes:

a) a lower frame having a rectangular positioning portion at the rim thereof, a plurality of air outflow/inflow channels being formed at the internal side of the rectangular positioning portion, a circular portion being positioned at the center thereof with a circular hole formed within the circular portion for the outflow/inflow of air;

b) a cover positioned on the lower frame;

c) a fan interposed between the lower frame and the cover for the outflow/inflow of the air from the air outflow/inflow channels as well as for the suction/delivery thereof through the circular hole inside, thereby creating an air-conditioning circulation machine is created, wherein a mounting seat is positioned within the circular hole and supported by a plurality of ribs, and a bearing block is provided at the center of the mounting seat for receiving a bearing;

wherein a diversion disc is positioned within the circular hole, and the diversion disc includes a connection shaft at the center thereof and fits upwards into the connection shaft of the bearing block so as to be in connection with the bearing, thereby creating a free rotation of the connection shaft in the circular hole; and wherein the diversion disc includes a plurality of radial separation pieces, and a plurality of conic and ring-shaped diversion pieces are concentrically and outwardly positioned around the connection shaft, and the diversion disc is separated by the ring-shaped diversion pieces and the radial separation pieces to create a plurality of air inflow/outflow zones, and all of the ring-shaped diversion pieces at the bottom of the diversion disc are not positioned at the same height, but they have a downward protruding middle part and a staged structure at the rim thereof so as to form a ∪-shape.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
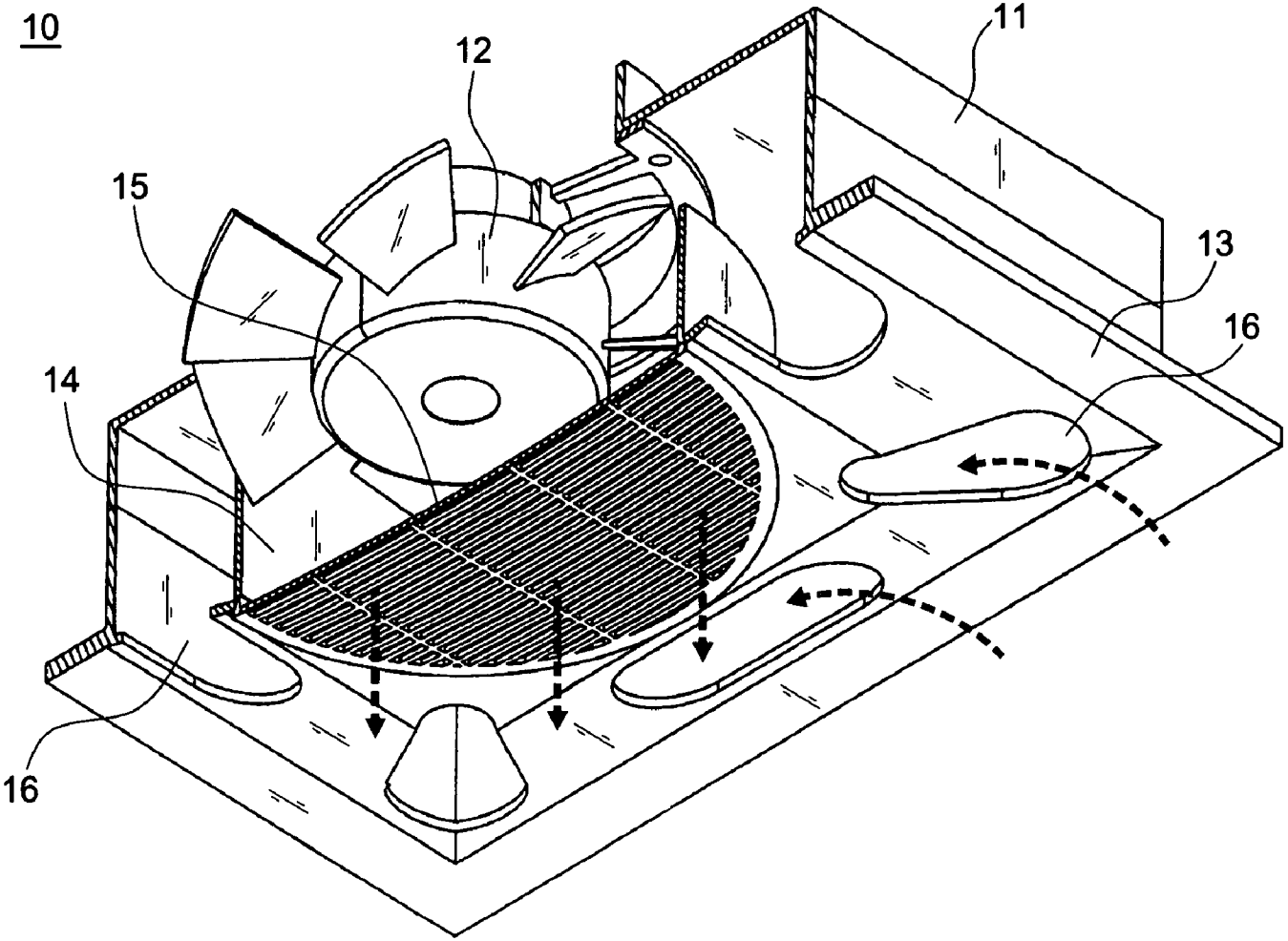
FIG.1 PRIOR ART
FIG. 1 is a cutaway view of a conventional circulation fan.
Figure 2:
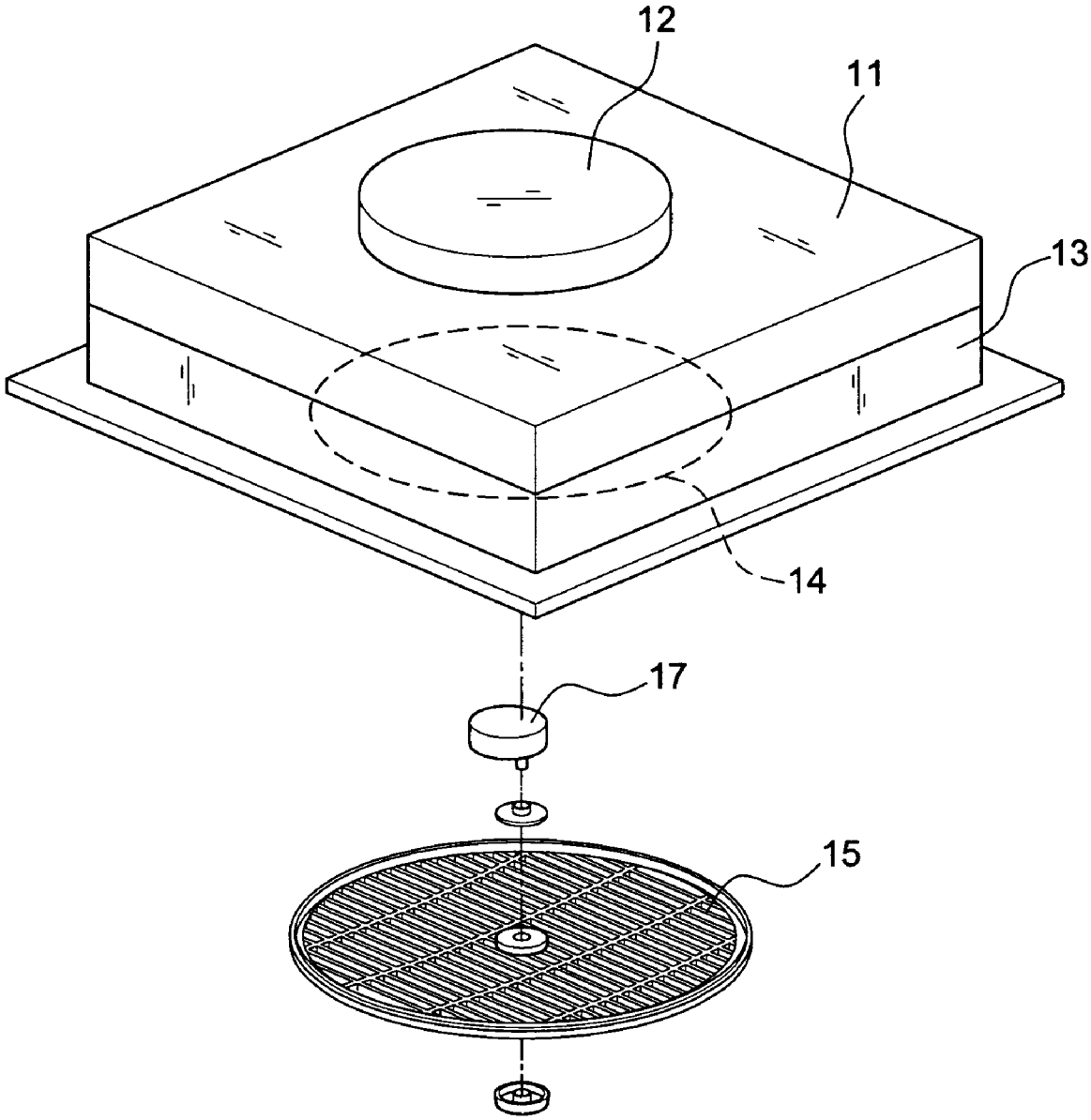
FIG.2 PRIOR ART
FIG. 2 is an exploded perspective view of another conventional circulation fan.
Figure 3:
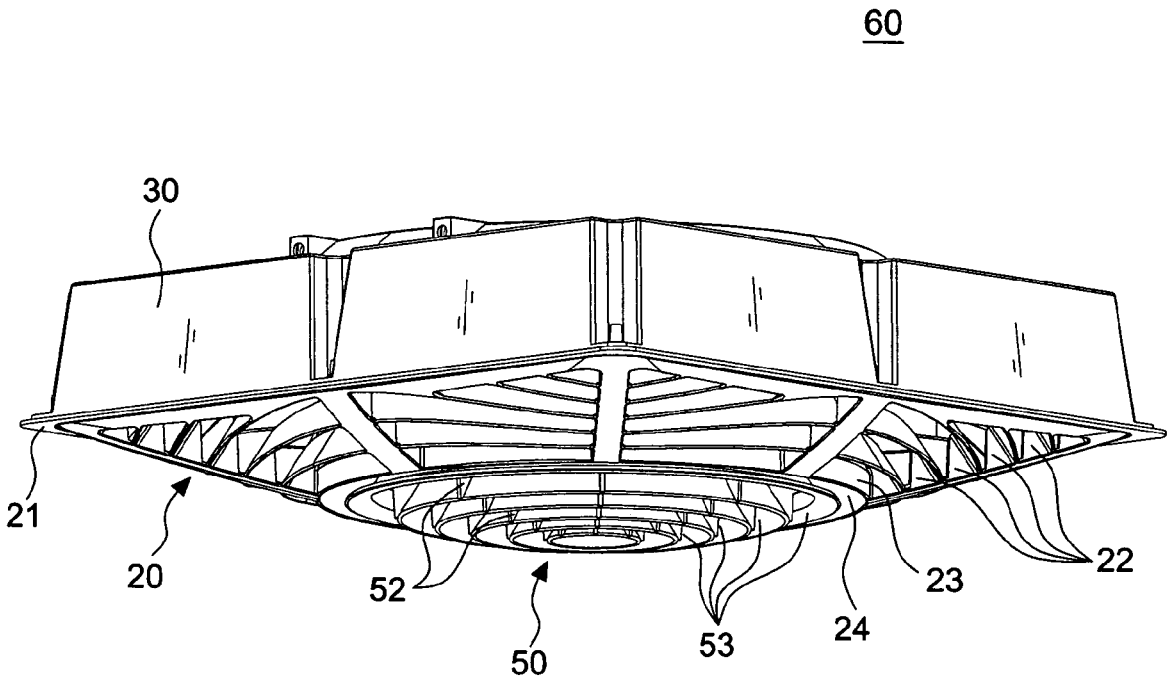
FIG. 3 is a perspective view of a powerless diversion plate of a ceiling air-conditioning circulation machine according to the invention.
Figure 4:
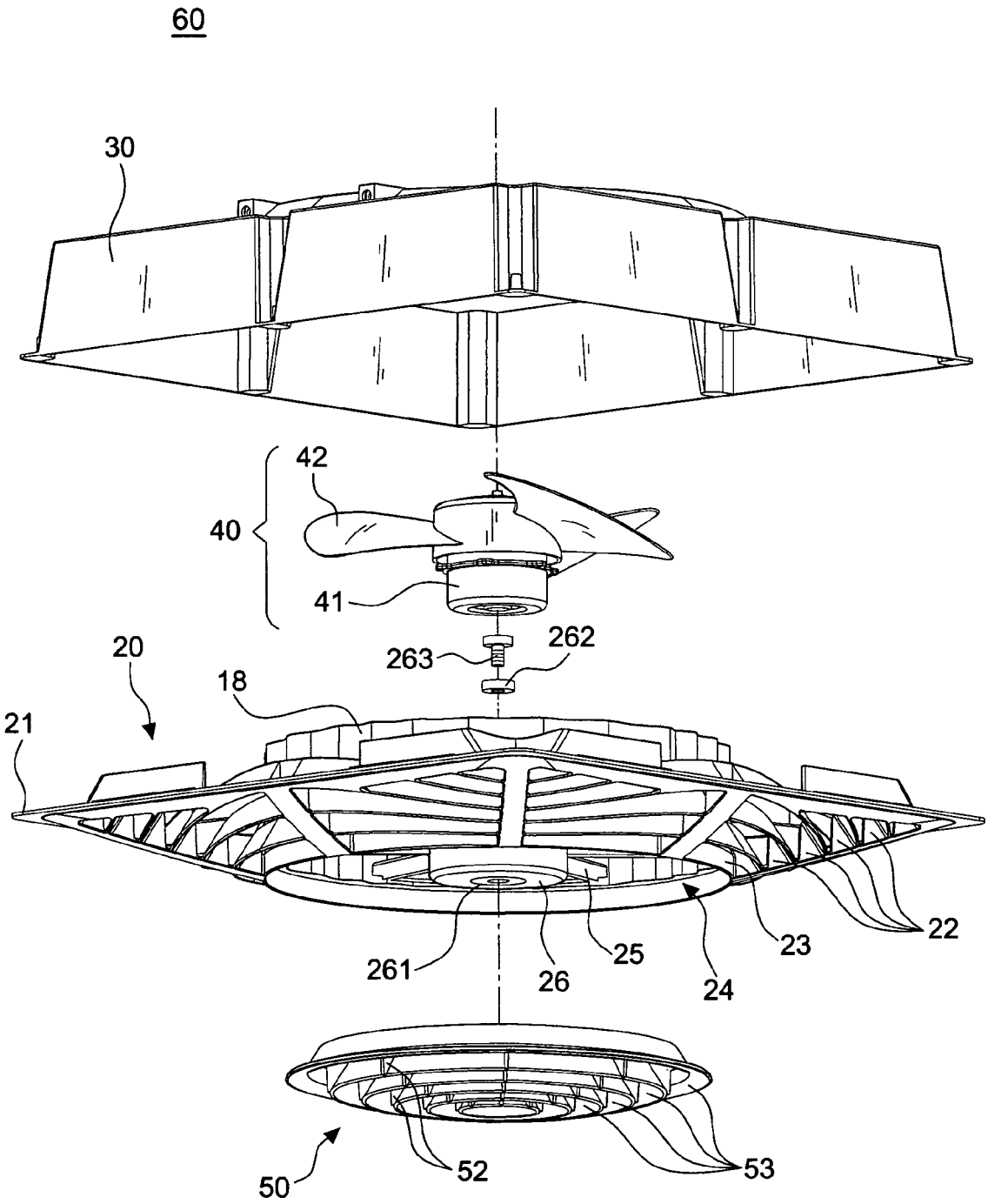
FIG. 4 is an exploded perspective view of a powerless diversion plate of a ceiling air-conditioning circulation machine according to the invention.
Figure 5:
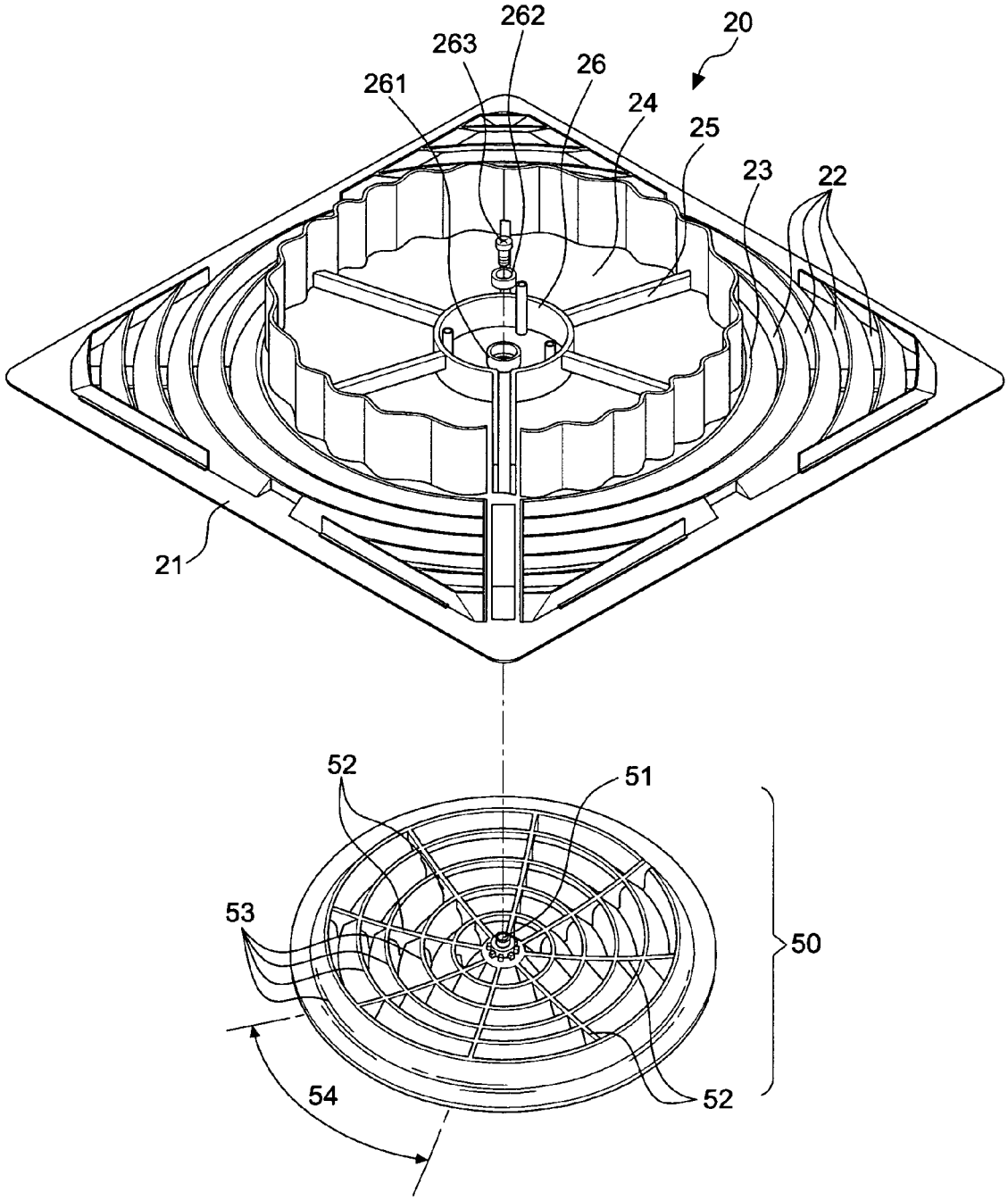
FIG. 5 is an exploded perspective view of a diversion disc and a lower frame according to the invention.

First of all, referring to FIGS. 3 through 5, a preferred embodiment of a powerless diversion plate of a ceiling air-conditioning circulation machine in accordance with the invention includes a lower frame 20, a cover 30, and a fan 40.

The lower frame 20 includes a rectangular positioning portion 21 at the rim thereof. A plurality of air outflow/inflow channels 22 are formed at the internal side of the rectangular positioning portion 21. A circular portion 23 is positioned at the center thereof with a circular hole 24 formed within the circular portion 23 for the outflow/inflow of air.

The cover 30 is positioned on the lower frame 20.

The fan 40 includes a motor 41 and a vane wheel 42 and interposed between the lower frame 20 and the cover 30. The fan 40 is employed for the outflow/inflow of the air from the air outflow/inflow channels 22 as well as for the suction/delivery thereof through the circular hole 24 inside. In this way, an air-conditioning circulation machine 60 is created. According to this embodiment, the fan 40 is disposed within the circular hole 24 of the lower frame 20, but the installation should not be restricted thereto. In other words, the fan 40 can also be mounted at the bottom of the cover 30. This belongs to the prior art and is not the object of the invention so that no further descriptions thereto are given hereinafter.

A mounting seat 26 is positioned within the circular hole 24 and supported by a plurality of ribs 25. A bearing block 261 is provided at the center of the mounting seat 26 for receiving a bearing 262.

Figure 6:
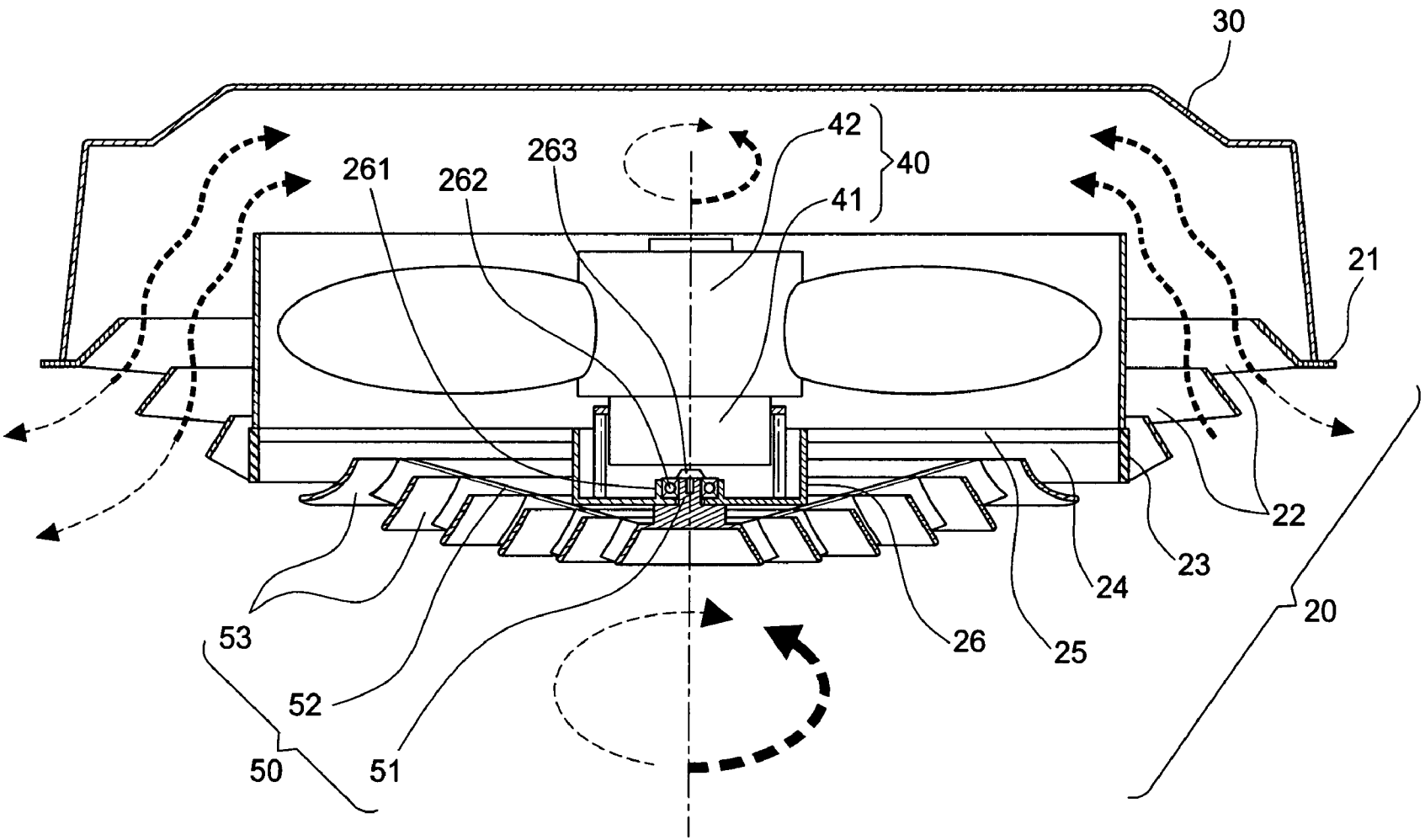
FIG. 6 is a cutaway view of the invention in an operational state.
Figure 6A:
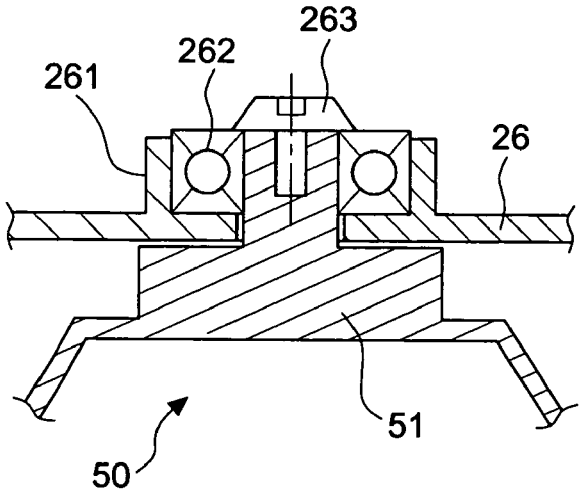
FIG. 6A is an enlarged view of a partial structure in FIG. 6.

A diversion disc 50 is positioned within the circular hole 24. The diversion disc 50 includes a connection shaft 51 at the center thereof and fits upwards into the connection shaft 51 of the bearing block 261 so as to be in connection with the bearing 262. In this way, a free rotation of the connection shaft 51 in the circular hole 24 is ensured. According to another preferred embodiment, a positioning piece 263 is placed on the bearing 262 when the connection shaft 51 fits into the bearing block 261 and the bearing 262. As a result, the connection shaft 51 won't be loosened (see FIG. 6A).

Figure 6B:
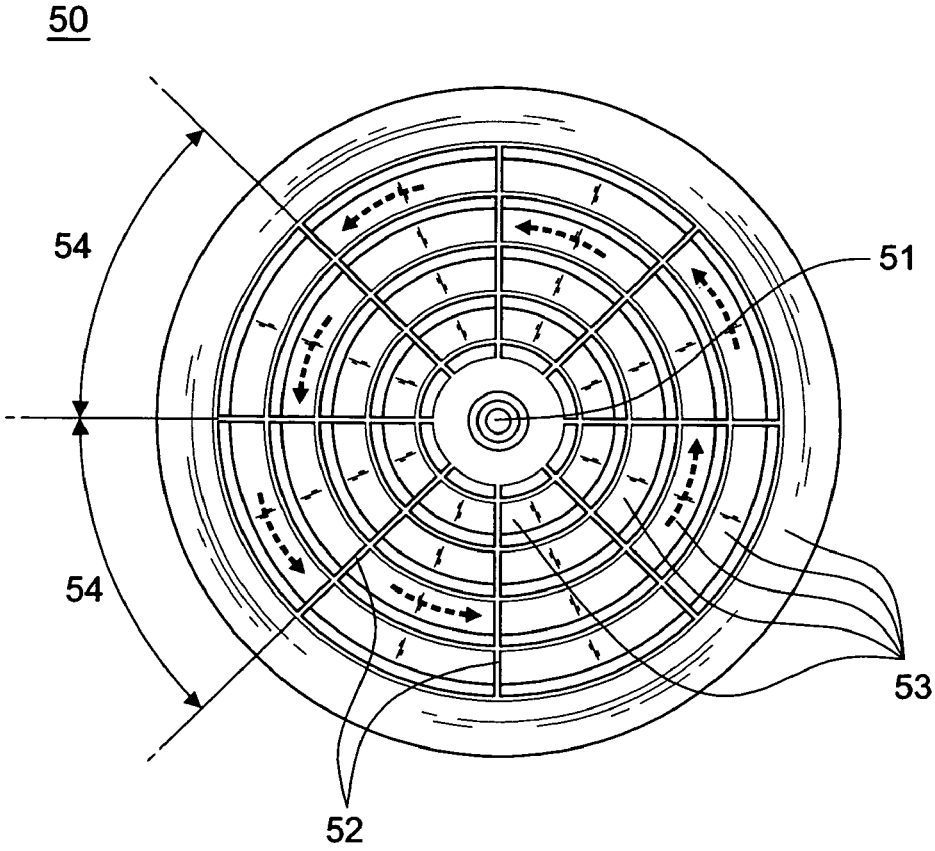
FIG. 6B is a top view of the diversion disc in FIG. 6.

Moreover, the diversion disc 50 includes a plurality of radial separation pieces 52. A plurality of conic and ring-shaped diversion pieces 53 are concentrically and outwardly positioned around the connection shaft 51. The diversion disc 50 is separated by the ring-shaped diversion pieces 53 and the radial separation pieces 52 to create a plurality of air inflow/outflow zones 54. According to the embodiment shown in FIG. 6B, there are eight air inflow/outflow zones 54. The number thereof should not be restricted thereto. Six or ten air inflow/outflow zones 54 are also possible. The radial separation pieces 52 are indispensable elements of the invention. They are not necessarily formed in a linear way. However, the action of the radial separation pieces 52 have to be arranged in a crossed way relative to the ring-shaped diversion pieces 53. When the fan 40 rotates clockwise/counterclockwise (see FIG. 6), a current of air in clockwise/counterclockwise direction is created within the circular hole 24. At that time, the force of the current of air acts on the side (vertical side) of the radial separation pieces 52 so that the radial separation pieces 52 rotate clockwise/counterclockwise on the connection shaft 51. Only when the fan 40 rotates, the diversion disc 50 rotates with it in the same direction. It is not necessary to install a drive motor on the shaft or at the rim of the diversion disc 50, thereby creating a powerless structure. In other words, a push force within the air inflow/outflow zones 54 is created completely by the current of air delivered by the fan 40. As a result, a powerless and automatic rotation is ensured. In fact, the air within a room can be drawn from the circular hole 24 at the center thereof and delivered via the ring-shaped diversion pieces 53 at the rim thereof outside. Alternatively, the air outside can be drawn through the ring-shaped diversion pieces 53 at the outer rim and delivered via the circular hole 24 at the center thereof outside. The above-mentioned relates just to the adjustment of the inflow/outflow so that no further descriptions thereto are given hereinafter.

Figure 7:
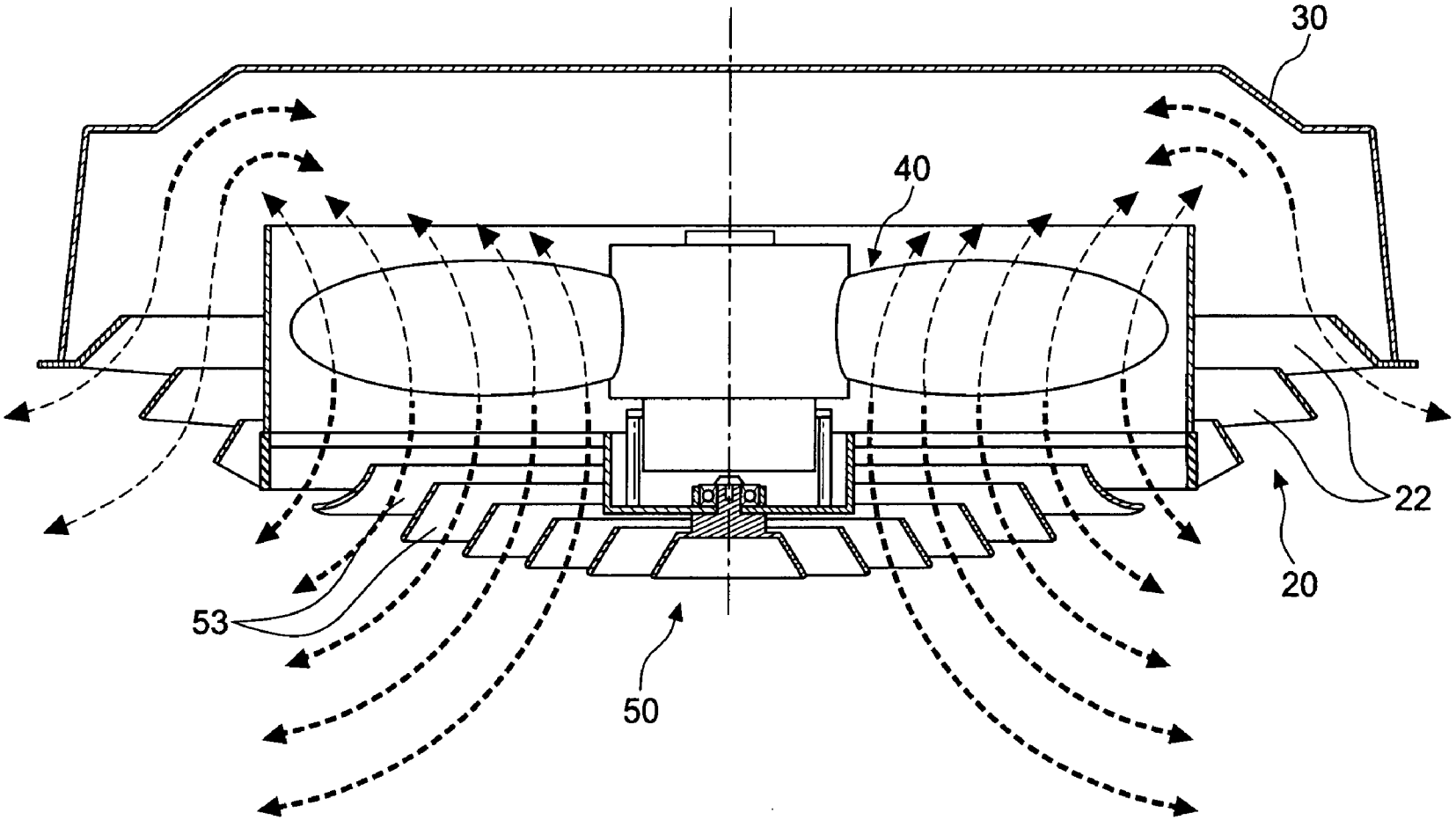
FIG. 7 is a cutaway view of the invention in another operational state.

Another feature of the diversion disc 50 in accordance with the invention lies in that the bottom thereof has a downward protruding middle part and a staged structure at the rim thereof so as to form a ∪-shape. In other words, not all of the ring-shaped diversion pieces 53 are positioned at the same height. In this way, the circulating air coming from or going into the air inflow/outflow zones 54 can turn around by additional use of the ring-shaped diversion pieces 53. The structure that the middle part is lower and the rim part gradually rises to create a /\-shaped downward diffusion or upward suction, as shown in FIG. 7, may enhance the convection and air-generating effect. Moreover, the circulation efficiency is increased.

Moreover, a plurality of conic air outflow/inflow channels 22 are formed between the rectangular positioning portion 21 and the circular portion 23 of the lower frame 20. The air outflow/inflow channels 22 are arranged in outward and concentric way. In addition, the air outflow/inflow channels 22 corresponding to the diversion disc 50 are formed in an arched shape such that the entire structure fulfills the hydromechanic design requirements for inflow and outflow of air.

According to the above-mentioned structure, it is not necessary to install a motor to drive the diversion disc 50. Instead, the radial separation pieces 52 of the diversion disc 50 serve as working surface. When the air delivery force created by the fan acts on the radial separation pieces 52, the diversion disc 50 is driven in rotation at 360°. In this way, a powerless and automatic rotation is achieved for guiding the current of air. In addition to the automatic rotation, the diversion disc 50 enables the air to be diffused downward or sucked upward in a /\-shaped flowing way, thereby enhancing the air-outflowing and convection efficiency.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A powerless diversion plate of a ceiling air-conditioning circulation machine, comprising:

a) a lower frame having a rectangular positioning portion at the rim thereof, a plurality of air outflow/inflow channels being formed at the internal side of the rectangular positioning portion, a circular portion being positioned at the center thereof with a circular hole formed within the circular portion for the outflow/inflow of air; b) a cover positioned on the lower frame;

c) a fan interposed between the lower frame and the cover for the outflow/inflow of the air from the air outflow/inflow channels as well as for the suction/delivery thereof through the circular hole inside, thereby creating an air-conditioning circulation machine is created, wherein a mounting seat is positioned within the circular hole and supported by a plurality of ribs, and a bearing block is provided at the center of the mounting seat for receiving a bearing;

wherein a diversion disc is positioned within the circular hole, and the diversion disc includes a connection shaft at the center thereof and fits upwards into the connection shaft of the bearing block so as to be in connection with the bearing, thereby creating a free rotation of the connection shaft in the circular hole; and wherein the diversion disc includes a plurality of radial separation pieces, and a plurality of conic and ring-shaped diversion pieces are concentrically and outwardly positioned around the connection shaft, and the diversion disc is separated by the ring-shaped diversion pieces and the radial separation pieces to create a plurality of air inflow/outflow zones, and all of the ring-shaped diversion pieces at the bottom of the diversion disc are not positioned at the same height, but they have a downward protruding middle part and a staged structure at the rim thereof so as to form a ∪-shape.

2. The powerless diversion plate of a ceiling air-conditioning circulation machine as recited in claim 1 wherein a positioning element is disposed at the top of the connection shaft.

3. The powerless diversion plate of a ceiling air-conditioning circulation machine as recited in claim 1 wherein the air outflow/inflow channels includes a plurality of conic and ring-shaped pieces concentrically and outwardly arranged.

* * * * *